US006058538A

United States Patent [19]

Chapman et al.

[11] Patent Number: 6,058,538

[45] Date of Patent: May 9, 2000

[54] PATIENT SUPPORT

[75] Inventors: Paul William Chapman; Veronica Irene Fletcher, both of Bedfordshire; Alastair George McLeod, Rugby; Clive Russel Perry, Bedfordshire, all of United Kingdom

[73] Assignee: Huntleigh Technology, PLC, Bedfordshire, United Kingdom

[21] Appl. No.: 09/322,250

[22] Filed: May 28, 1999

Related U.S. Application Data

[63] Continuation of application No. PCT/GB98/02988, Oct. 7, 1998.

[51] Int. Cl.[7] ..... A61G 7/06

[52] U.S. Cl. ..... 5/713; 5/715

[58] Field of Search ..... 5/638, 710, 713, 5/715, 725, 733

[56] References Cited

U.S. PATENT DOCUMENTS

| | | | |
|---|---|---|---|
| 1,772,310 | 8/1930 | Hart | 5/713 |
| 3,978,530 | 9/1976 | Amarantos | 5/710 X |
| 4,225,989 | 10/1980 | Corbett et al. | 5/710 X |
| 4,428,087 | 1/1984 | Horn | 5/725 X |
| 4,639,960 | 2/1987 | Quillen et al. | 5/710 |
| 4,941,221 | 7/1990 | Kanzler | 5/615 |
| 5,611,096 | 3/1997 | Bartlett et al. | 5/710 X |

*Primary Examiner*—Michael F. Trettel
*Attorney, Agent, or Firm*—Brown Raysman Millstein Felder & Steiner LLP

[57] ABSTRACT

A patient support includes an alternating pressure pad having separate sets of alternately inflatable cells and at least one further inflatable cell under the pad, with a support for the head of a patient lying thereon, and a control mechanism arranged to maintain alternate inflation and deflation of the cells of the pad to deflate the cells at the head end of the pad and also to inflate the cells under the pad in order to raise the level of the chest of a patient supported on the pad.

20 Claims, 4 Drawing Sheets

PATIENT SUPPORT

This application is a continuation of PCT/GB98/02988 filed Oct. 7, 1998.

BACKGROUND OF THE INVENTION

1. Field of the Invention

This invention relates to a patient support and in particular to an alternating pressure pad used in prone nursing.

2. Discussion of Related Art

Alternating pressure pads are commonly used in the prevention of decubitus ulcers in bedridden patients, but such patients requiring mechanical ventilation or artificial respiration may need to be nursed in the prone position in order to increase the oxygen level in arterial blood, achieved by liberating the dorsal alveoli from lung oedema fluid.

Prone nursing is a technique in widespread use, with existing systems requiring the patient to be laid face down onto a bed having specific mechanical lifting aids to lift the patient's chest off the bed to provide a space beneath the face and neck for nasal, ventilation and tracheotomy tubes to be inserted and hang freely from the patient. With the patient in this position, a nurse has access to the face and neck areas for nasogastric tubes, endogastric tubes, ventilator hoses and tracheotomoy tubing, as appropriate, and can perform medical procedures such as pulmonary drainage via suction.

However, such existing systems require the movement of a patient to a bed suitably equipped with lifting equipment which have been known in the past to cause facial pressure sores at their points of contact.

SUMMARY OF THE INVENTION

The invention seeks to provide an alternating pressure pad capable of supporting a patient in a prone position thereby avoiding the need to move the patient to a different bed and additionally maintaining pressure relief for the patient.

Accordingly, the invention provides a patient support comprising an alternating pressure pad having separate sets of alternately inflatable cells, at least one further inflatable cell provided under the pad, means to support a head of a patient lying thereon, and control means arranged to maintain alternate inflation and deflation of the cells of the pad, to deflate the cells at the head end of the pad and also to inflate the cell(s) provided under the pad in order to raise the level of the chest of a patient supported on the pad.

The deflation of the cells at the head end of the pad provides a space beneath the face and neck of a patient for nasal, ventilation and tracheotomy tubes to be inserted and hang freely. Inflation of the cell under the pad raising the level of the lungs above the rest of the body lowers the abdominal tissue pressure thereby reducing pressure on the diaphragm and allowing greater tidal air volume during artificial respiration. As a result, there is greater perfusion and oxygenation of the dorsal lower lung area reducing accumulation of oedema around the lung and chest area.

Preferably, at least one inflatable cell is provided under the foot end of the pad which when inflated raises the feet of a patient supported on the pad. Preferably the cells under the pad may be inflated laterally to provide rotational therapy for the patient.

Preferably, the pad includes at least a further inflatable cell to support the face and shoulder of a person lying thereon. More preferably, the cell is V-shaped and may be semi-transparent to allow inspection of the face from the side of the pad without movement of the head. The combined action of the deflated head cells, the cells elevating the chest and feet and the V-shaped cell to raise the face and neck provides an optimum position for prone nursing which is difficult to achieve on conventional air beds or pads.

Preferably, the alternately inflatable cells for supporting the abdomen of a patient lying thereon may be individually selectively deflated to facilitate breathing.

Preferably a cover extends over and around the pad.

Preferably, the control means and means for selectively deflating some of the cells are accessible outside the cover, for ease of operation and reduced risk of contamination of the pad.

BRIEF DESCRIPTION OF THE INVENTION

An example of the invention will now be described with reference to the accompanying drawings, in which.

Figure 4A:
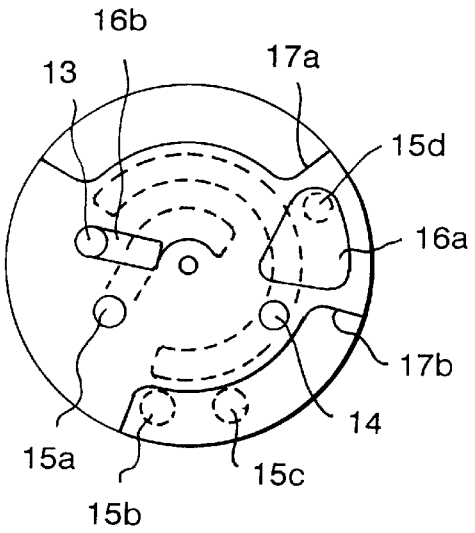
Figure 4B:
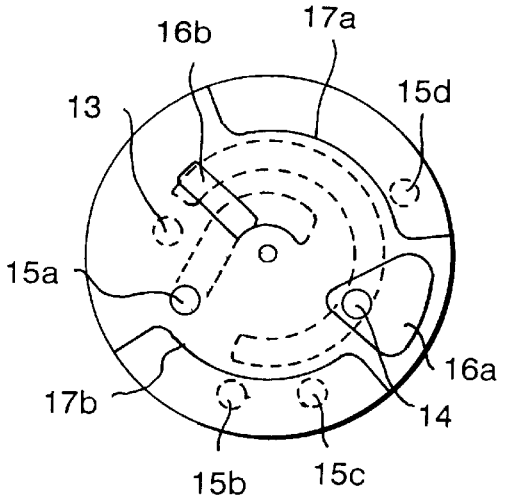

FIGS. 4*a*–4*b* are schematic views of an air switch.

DETAILED DESCRIPTION OF THE PREFERRED EMBODIMENTS

Figure 1:
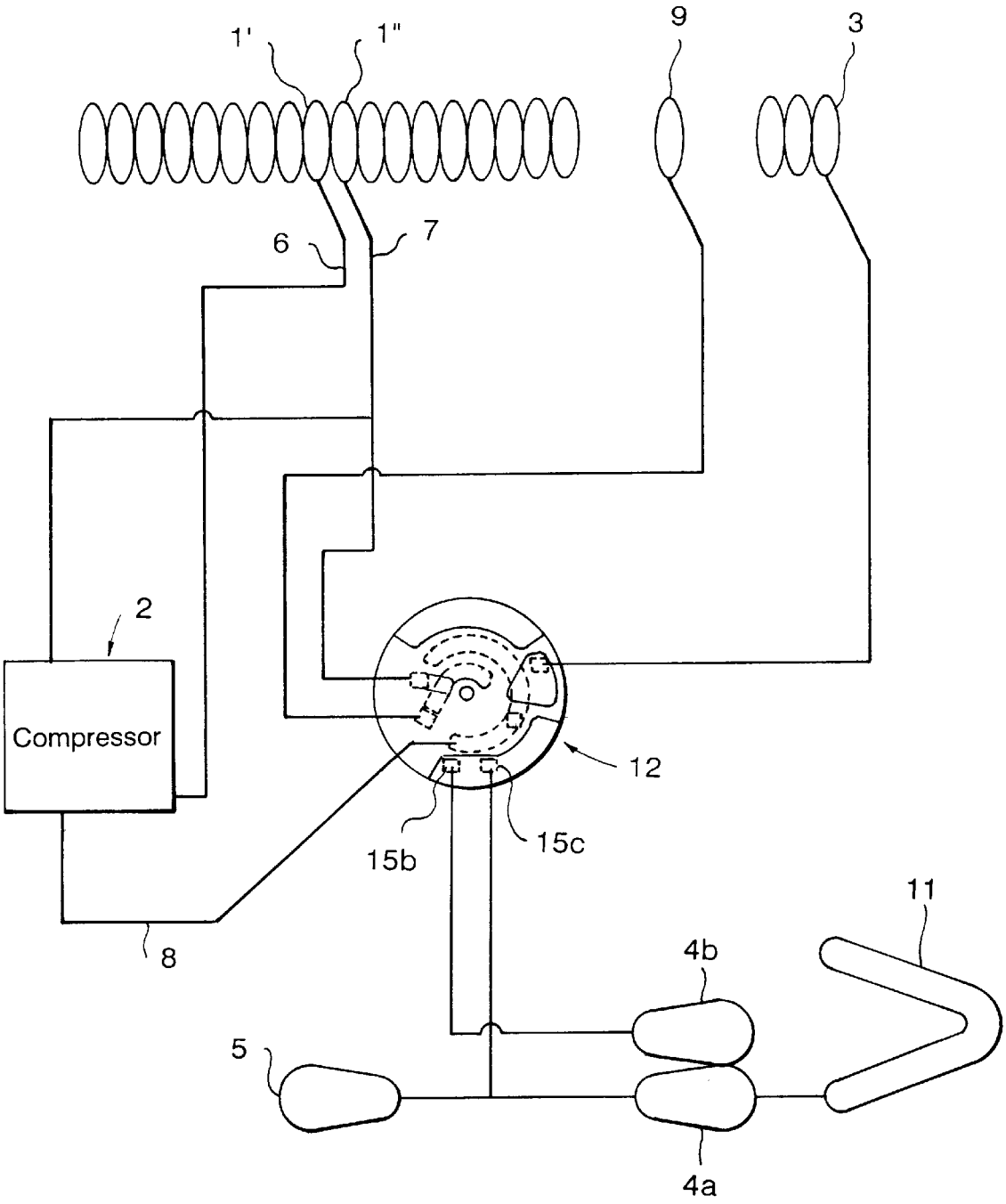
FIG. 1 shows a schematic representation of a preferred embodiment of the invention.

Referring now to FIG. 1, the preferred embodiment comprises an alternating pressure pad 1 including alternately inflatable cells 1', 1". The cells 1' and 1 " are alternately supplied with air from a compressor 2. The cells 1' and 1" are supplied air from respective channels 6 and 7. It is envisaged that cells in series of three or more may also be used or that more than one cell in any one series may be inflated alternately. Generally, the cells are shaped as elongate cylinders which in the preferred embodiment extend transversely across the pad.

The cells may be individually formed and restrained onto a base sheet to form the alternating pressure pad or may be made from top and bottom sheet material welded together to define alternately inflatable cells.

The cells 1', 1" are supplied with fluid by channels 6 and 7 which run along the side of the cells. These channels have non-return valve connections to a third channel 8 which feeds air continuously to the head cells 3 and the inflatable cells 4, having separately inflatable cells 4*a* and 4*b* as shown in FIG. 1, under the head end of the pad via the air switch 12. The inflatable cells 4 are positioned under the alternating cells for supporting the torso of a patient lying thereon, towards the head end, and arranged to inflate individually or together to provide torso height adjustment to enable ventilation access to the patients face. These cells 4 may be "U" shaped to contour around a pneumatic automatic pressure adjuster(not shown) which may be used to maintain an optimum support pressure level. Linked to the cells 4*a* may be a cell 5 that inflates to provide increased foot clearance. These cells 4*a* and 5, independent of cell 4*b*, may also be inflated laterally to provide rotational therapy for the patient.

The first alternating cell 1' or 1", next to the head cells 3 when deflated, may be converted to a static cell 9 so that constant support keeps the patient in a stable position.

In a preferred embodiment, a number of the remaining alternately inflatable cells 1' and 1" for supporting the torso of a patient may be connected to the feed channels 6 or 7 via two position valves 10.

Figure 3:
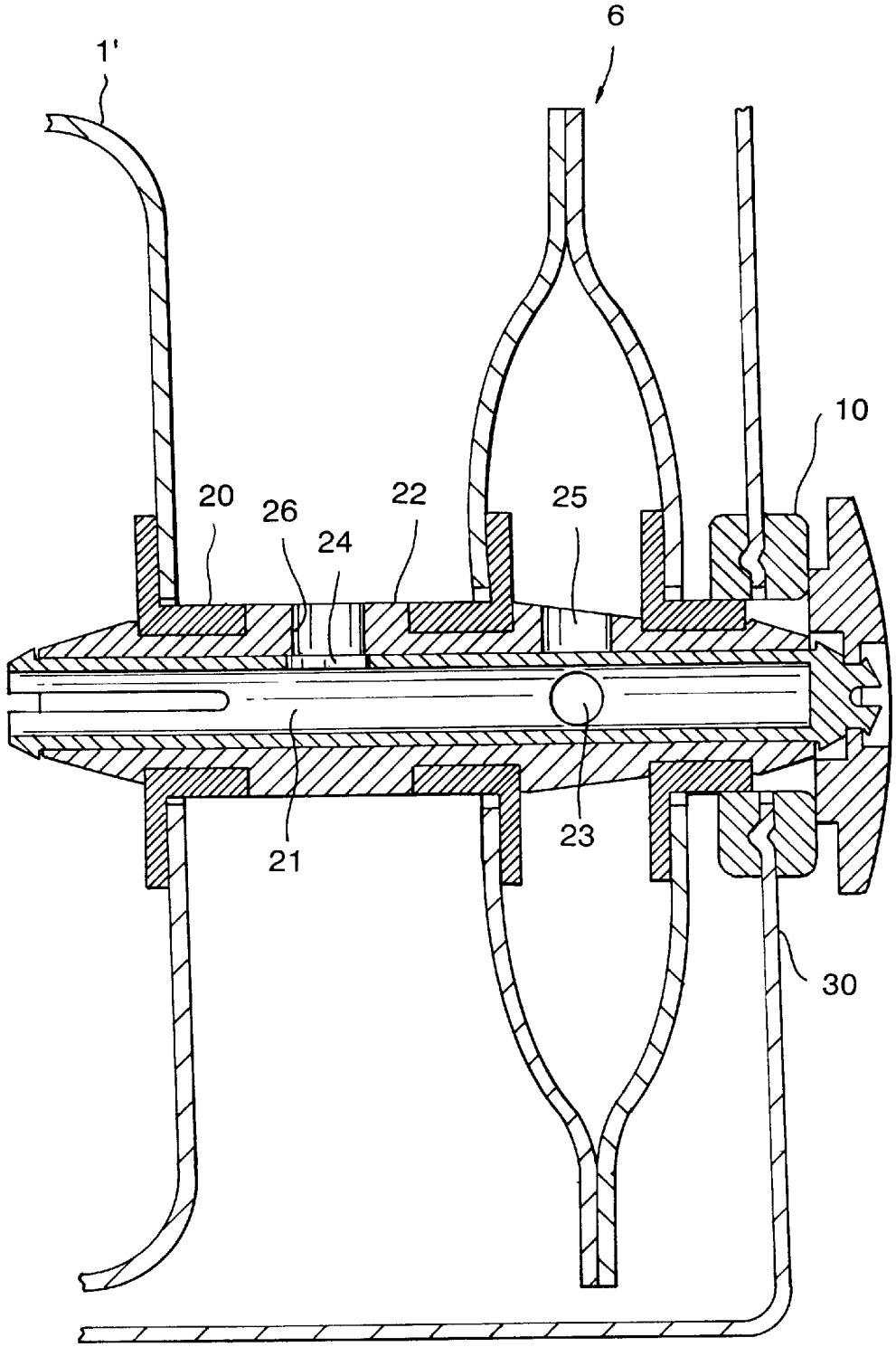
FIG. 3 is a cross-sectional view of a two position valve according to the invention.

As shown in FIG. 3, the valves 10 each comprise a body 20 extending through the individual pad cell 1' and channel 6 supplying air to it. The valve body end also passes through the outer cover 30. The valve body has two components, an inner component 21 inserted into the bore of an outer component 22, openings 23 and 24 are provided in the inner component and complimentary openings 25 and 26 are provided in the outer component with openings 23 and 25 interconnecting the cells 1' with channel 6. Openings 24 and 26 allow for venting of the cell 1'. However, the openings 25 and 26 in the outer component are laterally offset so that in one position the cell may be supplied with air by the respective channel and in the other position the cell may be disconnected from the channel and allowed to deflate without affecting the adjacent cells. Therefore, the valve 10 whilst allowing for individual cell deflation will isolate that cell from the channel 6 or 7 so that air is not lost from the system. The valves 10 also pass through the outer cover and have a knob attached which will indicate the "Vent/Close" positions. As access to operating these valves is on the outside the risk of contaminating the mattress is minimised.

Figure 2:
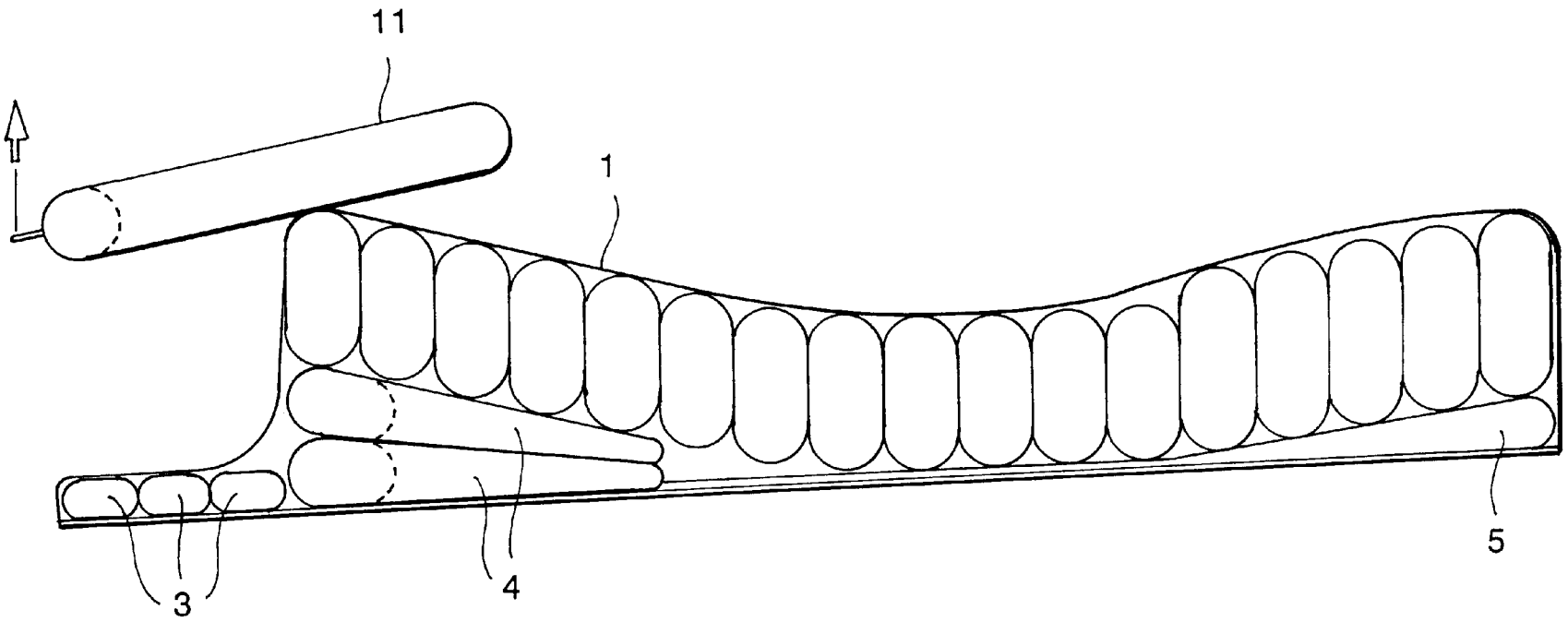
FIG. 2 is a schematic cross-sectional representation of the alternating pressure pad in FIG. 1.

As support for the head has been lost, by the head end cells 3 being deflated, a head support is required to maintain the head in the prone position above the pad 1. In the preferred embodiment as shown in FIGS. 1 and 2, a "V" shaped cell 11 may be provided that at its apex supports the head and with its two ends secured under the patients arm pits supports the patient's shoulders and chest. It is possible to use mechanical cantilever type mechanisms with a mask allowing access to the face and throat of the patient to support the head. Another option could be a more complex structure having a fold away design, with storage within the pad. Mounted to the frame could be a pressure reducing pad utilising either air, foam or gel agent whilst enabling access to the face and throat.

In use, the compressor 2 supplies pressurised air to channels 6 and 7 feeding alternately inflatable cells 1' and 1". A rotary valve (not shown) alternates the supply of air to the respective channels 6 and 7. The control of air supply to the rest of the cells is by means of an air switch 12. The air switch 12 comprises two mating faces, one stationary 12*a* and the other rotatable 12*b*. The stationary face 12*a* has an inlet 13 connected to channel 7, an inlet 14 connected to the compressor, outlet 15*a* to cell 9, outlets 15*b* and 15*c* to the cells 4 and 5 and outlet 15*d* to the head cells 3. The other mating face 12*b* has arced grooves 16*a* and 16*b* that are configured to feed air to the different outlets 15*a* to 15*d* and cutaway sections 17*a* and 17*b* to exhaust the air from outlets 15*a* to 15*b* depending on its position with respect to the stationary face 12*a*.

As shown in FIG. 4A, in position 1 the grooved quadrant 16*a* connects the inlet 14 to outlet 15*d* to supply continuous air to the head cells 3 and also groove 16*b* connects inlet 13 to outlet 15*a* to supply alternating air to cell 9. As the switch is moved to position 2 (FIG. 4B), the quadrant groove 16*a* cannot supply air to outlet 15*d* However, cutaway section 17*a* is now in position over outlet 15*d* allowing the head cells 3 to deflate. Groove 16*b* connects inlet 14 to outlet 15*a* to supply static air to cell 9.

Figure 4C:
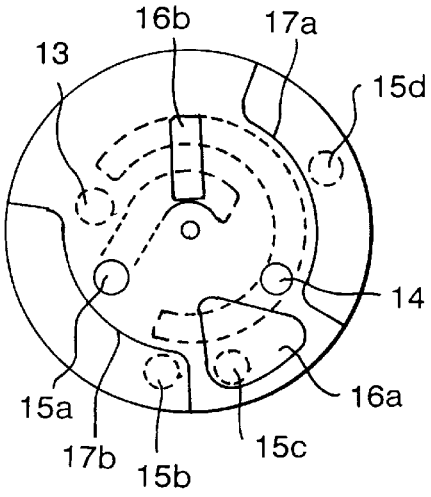
Figure 4D:
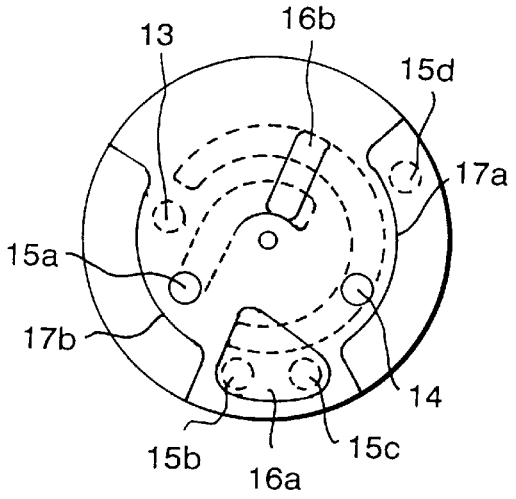

As the air switch is moved to position 3 (FIG. 4C), the head cells are still in exhaust mode, cell 9 is still connected to inlet 14 and the quadrant groove 16*a* is only feeding outlet 15*c* to supply air to cells 4*a* and 5, but not to cell 4*b*, which produces lateral rotation of the patient to one side. Moving the air switch to position 4 (FIG. 4D), the quadrant groove 16*a* is now in position to supply air to outlets 15*b* and 15*c* to inflate cells 4*a*, 4*b* and 5 at the head and foot ends respectively under the pad, the head cells are still in exhaust mode, and cell 9 is still connected to inlet 14 thereby providing the final prone position.

When returning back through the switch settings to position 1 the alternating pad is converted back to its conventional pressure relieving alternating pad mode and cells 4*a*, 4*b* and 5 exhaust via cutaway section 17*b*.

What is claimed is:

1. A patient support comprising:

an alternating pressure pad having separate sets of alternately inflatable cells, at least one further inflatable cell provided under the pad, means, including a curved pad positioned at a head end of the pad, for supporting the head of a patient lying thereon; and control means arranged to maintain alternate inflation and deflation of the cells of the pad, to deflate the cells at the head end of the pad and also to inflate the at least one cell under the pad in order to raise the level of the chest of a patient supported on the pad.

2. A patient support as claimed in claim 1, wherein at least one inflatable cell is provided under the foot end of the pad, which when inflated raises at least one foot of a patient supported on the pad.

3. A patient support as claimed in claim 1, wherein the cells under the pad may be inflated laterally to provide rotational therapy for the patient.

4. A patient support as claimed in claim 1, wherein a further inflatable cell is provided to support the face and shoulder of a patient lying thereon.

5. A patient support as claimed in claim 1, wherein the alternately inflatable cells of the pad are positioned for supporting the abdomen of a patient lying thereon and may be individually selectively deflated to facilitate breathing of the patient.

6. A patient support as claimed in claim 1, wherein a cover extends over and around the pad.

7. A patient support as claimed in claim 6, wherein the control means and the means for selectively deflating selected cells are accessible outside the cover, for ease of operation and reduced risk of contamination of the pad.

8. A patient support comprising:

an alternating pressure pad having separate sets of alternately inflatable cells;

at least one further inflatable cell provided under the pad;

means to support the head of a patient lying thereon; and control means arranged to maintain alternate inflation and deflation of the cells of the pad, to deflate the cells at the head end of the pad and also to inflate the at least one cell under the pad in order to raise the level of the chest of a patient supported on the pad;

wherein at least one inflatable cell is V-shaped and is semi-transparent.

9. A patient support comprising:

an alternating pressure pad having separate sets of alternately inflatable cells;

an inflatable undersupport cell provided under the pad; and control means for controllably maintaining alternate inflation and deflation of the cells of the pad, to deflate a predetermined set of head-end cells at a head end of the pad and also to inflate the undersupport cell under the pad in order to raise the level of the chest of a patient supported on the pad.

10. The patient support of claim 9, wherein the undersupport cell is positioned to be under the foot end of the pad, which when inflated, raises at least one foot of a patient supported on the pad.

11. The patient support of claim 10, wherein the under-support cell is dimensioned to raise both feet of a patient supported on the pad.

12. The patient support of claim 9, wherein the under-support cell is laterally inflatable to provide rotational therapy for the patient.

13. The patient support of claim 9, further comprising:

an upper-body support cell, being inflatable and including a curved pad, and positioned to support an upper-body portion of a patient lying thereon.

14. The patient support of claim 13, wherein the upper-body support cell supports at least one shoulder of a patient lying thereon.

15. The patient support of claim 13, wherein the upper-body support cell supports the face of a patient lying thereon.

16. The patient support of claim 9, wherein at least one of the cells is semi-transparent.

17. The patient support of claim 9, wherein the alternately inflatable cells of the pad are positioned for supporting the abdomen of a patient lying thereon.

18. The patient support of claim 9, wherein the alternately inflatable cells supporting the abdomen may be individually selectively deflated to facilitate breathing of the patient.

19. A patient support comprising:

an alternating pressure pad having separate sets of alternately inflatable cells, at least one further inflatable cell provided under the pad, means, including a curved pad positioned at a head end of the pad, for supporting the head of a patient lying thereon;

control means arranged to maintain alternate inflation and deflation of the cells of the pad, to deflate the cells at the head end of the pad and also to inflate the at least one cell under the pad in order to raise the level of the chest of a patient supported on the pad; and a cover extending over and around the pad.

20. The patient support of claim 19, wherein the control means and the means for selectively deflating selected cells are accessible outside the cover, for ease of operation and reduced risk of contamination of the pad.

* * * * *